US005262800A

United States Patent [19]

Smith et al.

[11] Patent Number: 5,262,800

[45] Date of Patent: Nov. 16, 1993

[54] THERMAL IMAGING SYSTEM

[75] Inventors: David P. H. Smith, Sawbridgeworth; Mark T. Leonard; David W. Swan, both of Harlow, all of England

[73] Assignee: Minnesota Mining and Manufacturing Company, St. Paul, Minn.

[21] Appl. No.: 869,217

[22] Filed: Apr. 13, 1992

Related U.S. Application Data

[63] Continuation of Ser. No. 563,288, Aug. 6, 1990, abandoned.

[30] Foreign Application Priority Data

Aug. 15, 1989 [GB] United Kingdom ..... 8918622

[51] Int. Cl.[5] ..... B41J 2/335

[52] U.S. Cl. ..... 346/76 PH

[58] Field of Search ..... 346/76 PH

[56] References Cited

U.S. PATENT DOCUMENTS

| | | | |
|---|---|---|---|
| 4,202,693 | 5/1980 | Moraw et al. | 430/50 |
| 4,277,145 | 7/1981 | Hareng et al. | 350/351 |
| 4,410,614 | 10/1983 | Lelental et al. | 340/76 R |
| 4,470,055 | 9/1984 | Todoh | 346/76 |
| 4,638,372 | 1/1987 | Leng et al. | 358/296 |
| 4,849,605 | 7/1989 | Nakamori et al. | 346/76 PH |

FOREIGN PATENT DOCUMENTS

| | | | |
|---|---|---|---|
| 2904793 | 8/1979 | Fed. Rep. of Germany . | |
| 3737449 | 5/1988 | Fed. Rep. of Germany . | |
| 0244563 | 10/1986 | Japan | 346/76 PH |
| 295555 | 12/1986 | Japan | 346/76 PH |
| 63-159063 | 1/1988 | Japan . | |
| 0039356 | 2/1988 | Japan | 346/76 PH |

OTHER PUBLICATIONS

MOPS, a magneto-optic-photoconductor sandwich for optical information storage, J. P. Kruume et al.

Electrically Amplified Optical Records, R. A. Lemons, vol. EDL3, 256 (1982).

*Primary Examiner*—Benjamin R. Fuller
*Assistant Examiner*—N. Le
*Attorney, Agent, or Firm*—Gary L. Griswold; Walter N. Kirn; Mark A. Litman

[57] ABSTRACT

A thermal imaging device having a print surface adapted to provide localised heating to a medium comprising a thermally activatable component of an imaging forming system, the device comprising the following sequential layers:

(a) a transparent or semi-transparent electrically conductive layer, (b) a photoconductive layer which when illuminated by radiation of 633 nm wavelength and intensity of $4.0\times10^6$ W/m$^2$ has a conductivity of at least 0.01 S/cm and a photosensitive ratio of at least $1\times10^3$, (c) an electrically conductive layer in electrical contact with the photoconductive layer (b) and in contact with:

(d) an abrasion-resistant wear layer, or, (e) a layer comprising said thermally activatable component of an image forming system;

wherein the layers are constructed and arranged such that when a voltage potential is applied across layers (a) and (c) and the device is exposed through layer (a), the exposed areas of layer (b) become conductive enhancing current flow and generating heat in layer (b) at points corresponding to the exposed areas and causing localised heating at the adjacent areas of the print surface sufficient to thermally activate said component of an image forming system. The thermal imaging devices are suitable for developing thermally sensitive paper or effecting thermal transfer of a colourant, dye, toner or other image forming material.

17 Claims, 2 Drawing Sheets

THERMAL IMAGING SYSTEM

This is a continuation of application Ser. No. 07/563,288 filed Aug. 6, 1990, abandoned.

FIELD OF INVENTION

This invention relates to thermal imaging systems and in particular to a multilayer thermal imaging device having a print surface adapted for developing thermally sensitive paper or effecting thermal transfer of a colourant, toner or other image forming material.

BACKGROUND TO THE INVENTION

In the market of medium to high quality colour hard copy derived from digital image information, thermal transfer printing is a leading technology, especially when using sublimation dye media. The main strengths of the technology lie in the reliability of the machines and their modest cost compared to photographic, electrophotographic or electrostatic printers. However, in terms of quality only the best and most expensive thermal printers approach photo-quality and for throughput and cost per copy all technologies trail behind electrophotography.

At present digital imaging of such materials is performed by thermal styli printheads. To provide a reasonable image quality, a high density of heat generating resistors is required which must be both accurately sized and of uniform resistance. To achieve this, several highly accurate microlithographic fabrication stages are required. The requirement that all the resistive elements must be functional and of uniform resistance at this level of fabrication complexity leads to a low yield and the cost of the thermal styli printhead is high. Applications requiring a higher resolution than 400 dots per inch (d.p.i.) are therefore not addressed by current thermal printing technology. Furthermore, only one of these high cost devices can economically be incorporated into a printing device. This causes serious disadvantages for full colour printing in which 3 or 4 colour separations must then be printed sequentially, which slows the throughput. Also the donor ribbon is printed in 3 or 4 sequential colours (cyan, magenta, yellow and optionally black) requiring the receptor paper to be re-registered for each colour on the single printhead. Each of the 3 or 4 colour ribbon donor sections is not normally re-usable and so the cost of a colour print is constant and high.

Therefore there is a need for a thermal imaging assembly having improved resolution and cost efficiency for multi-coloured printing.

IEEE Electron Device Letters, Vol. EDL3, P.254 (1982), Applied physics Letters, Vol. 42, p 484 (1983), U.S. Pat. Nos. 4,052,208 and 4,397,390, British Patent No. 2004077, French Patent No. 2402897, German Patent No. 2740835 and Japanese Patent No. 61010064 disclose thermoelectrographic processes having a thermal imaging device comprising a trilayer element of a photoconductor interposed between two electrodes, at least one electrode being substantially transparent. The second electrode or the photoconductor is thermally deformable or heat disintegrating such that following primary exposure to the image to be recorded and concomitant Joule heating arising from current flow in the conductive path, a permanent image comprising pits or holes is produced which is read for optical data storage.

U.S. Pat. No. 4,277,145, European Patent No. 12851 and German Patent No. 2904793 disclose an imaging assembly having a thermal imaging device of multilayer format in which a reflective second electrode is in intimate association with a liquid crystal layer. Isotropic change in the liquid crystal caused by Joule heating as the thermal imaging device is scanned and its subsequent cooling scatters light to produce an image for display.

German Patent No. 2904793 discloses an imaging assembly having a thermal imaging device comprising a support, an electrically conductive layer and a recording layer containing an oxidisable or reducible compound. A photoconductor with a conductive backing is brought into contact with the recording medium and upon light exposure, a current caused to flow through the recording medium produces a chemical reaction. The assembly is then heated at 130° C. for 30 seconds to give a positive image of continuous tone.

U.S. Pat. No. 4,470,055 discloses a thermoelectrographic device having an ink transferral drum comprising a transparent substrate, a transparent electrode and a photoconductor. An ink, being solid at room temperature and having heat-fusing and semiconductive properties is coated onto the drum and paper brought into contact with the ink. With a voltage applied between the ink layer and the transparent electrode, illumination from within the drum causes the photoconductor to switch to a low resistance state and the Joule heating in the ink layer causes fusion and transferral of ink to the paper.

Japanese Patent No. 61244563 discloses a thermal imaging device comprising a transparent substrate, a transparent electrode, a photoconductor, a resistive heat generating layer and a further electrode. The device is addressed by a laser through the transparent substrate and electrode and in the light struck areas, the photoconductor switches to a low resistance state causing a large electric field to develop in the resistive layer. The Joule heating effect in this layer is then used to develop thermally sensitive paper.

The thermal image assembly incorporating such a thermal imaging device has a relatively low resolution (approximately 100 d.p.i.(4 dots per mm)).

A magneto-optic device is disclosed in the Journal of Applied Physics, Vol. 48 P.366 (1977), comprising non-magnetic garnet substrate bearing on one surface a ferrimagnetic garnet film, on which is deposited a first transparent electrode layer, followed by a photoconductor layer and a second transparent electrode layer. When a voltage is applied across the electrodes and the device is laser-exposed, sufficient joule heating occurs to bring about magneto-optical switching of the ferrimagnetic garnet layer. The device is useful for optical data storage.

Japanese Patent Application No. 63-159063 discloses a thermal imaging device comprising an amorphous silicon photoconductor sandwiched between two electrodes, at least one of which is transparent while the other bears a further wear-resistant coating. When a voltage is applied across the electrodes, and the device is illuminated by a laser diode through the transparent electrode, sufficient heat is generated via Joule heating to image thermally-sensitive paper held in contact with the wear-resistant layer. The performance quoted for this device includes a writing speed of $10^{-2}$ sec/mm, and a conductivity of $10^{-5}$ S/cm for illumination by a 5 mW laser diode emitting at 780 nm. Much higher writing speeds (e.g., by two orders of magnitude) are necessary for such a device to have practical applications. Much higher sensitivities are required, especially if more energy-demanding imaging media, such as dye-sublimation media, are to be employed.

U.S. patent application No. 4,638,372, European Patent Application No. 138221A, German Patent Application No. 3737449A1 and Japanese Patent Application No. 60085675A disclose thermal imaging assemblies having multiple printheads of the thermal stylus type for multi-colour thermal transfer printing but these devices have proven to be economically unfeasible.

BRIEF SUMMARY OF INVENTION

There has now been found a thermal imaging device having a simplicity of structure and fabrication and having a particular utility to a thermal imaging assembly having improved resolution and/or multi-colour imaging capability when compared to conventional electrothermographic printers.

According to one aspect of the present invention there is provided a thermal imaging device having a print surface adapted to provide localised heating to a medium comprising a thermally activatable component of an imaging forming system, the device comprising the following sequential layers:

(a) a transparent or semi-transparent electrically conductive layer, (b) a photoconductive layer which when illuminated by radiation of 633 nm wavelength and intensity of $4.0\times10^6$ W/m$^2$ has a conductivity of at least 0.01 S/cm and a photosensitive ratio of at least $1\times10^3$, (c) an electrically conductive layer in electrical contact with the photoconductive layer (b) and in contact with:

(d) an abrasion-resistant wear layer, or, (e) a layer comprising said thermally activatable component of an image forming system;

wherein the layers are constructed and arranged such that when a voltage potential is applied across layers (a) and (c) and the device is exposed through layer (a), the exposed areas of layer (b) become conductive enhancing current flow and generating heat in layer (b) at points corresponding to the exposed areas and causing localised heating at the adjacent areas of the print surface sufficient to thermally activate said component of an image forming system, the device not containing ferrimagnetic garnet materials.

DESCRIPTION OF PREFERRED EMBODIMENTS

Transparent or semi-transparent electrically conductive layer (a) may comprise any suitable material known to the art of electronic imaging, having a transparency commensurate with the exposing power sufficient to generate the required photocurrent, typically at least 70%, and providing an electrical contact with the photoconductive layer (b). Conductive layer (a) may comprise an ultra-thin metal layer, e.g., silver, gold, copper etc., with a thickness less than the wavelength of the exposure source, but preferably comprises indium oxide, tin oxide, cadmium indium oxide, cadmium tin oxide or indium tin oxide and in a most preferred embodiment comprises an indium tin oxide layer, typically having greater than 90% transparency and a sheet resistance of from 5 to 200 ohms/square with a typical value of about 30 ohms/square. The thickness of conductive layer (a) is selected allowing for composition, surface roughness, conductivity and transparency considerations, and is typically 0.3 μm but may be 0.1 μm or less. The upper limit is governed by transparency, but is generally no greater than 1.0 μm.

Photoconductive layer (b) may comprise any material known to the art of photoconductors having a high sensitivity and good thermal stability. Suitable photoconductive media having high sensitivity possess a conductivity of at least 0.01 S/cm, more preferably 0.1 to 10 S/cm and a photosensitive ratio of at least $1\times10^3$, preferably at least $1\times10^5$ when illuminated by radiation of 633 nm wavelength and intensity of $4.0\times10^6$ W/m$^2$ measured under steady state. The photosensitive ratio is the ratio of the illuminated conductivity of a thermal imaging device to the dark conductivity. In an alternative embodiment the photoconductive layer when illuminated by white light of $10^3$ W/m$^2$ intensity exhibits a conductivity of at least $3\times10^{-5}$ S/cm. Suitable photoconductive media showing thermal stability survive repeated cycling to high temperatures (e.g., 400° C.) without decomposition or change in properties. The photoconductive layer typically has a thickness of 6.0 μm but may be from 1.0 to 20.0 μm. Thin layers give the best resolution, but run the risk of coating defects such as pinholes. Preferred materials are selected from cadmium sulfide, cadmium selenide, cadmium telluride, gallium arsenide, lead sulfide, lead selenide, zinc oxide or mixtures thereof. As it is essential that the photoconductive layer has a combination of high illuminated conductivity and fast response time, especially for digital imaging using thermal transfer colourants, it is highly preferred that the photoconductor is doped with copper in an amount up to 500 p.p.m. Generally, the amount of copper dopant will not be more than 180 p.p.m, typically no more than 80 p.p.m. Other dopants acting as compensating acceptors may also be used, e.g., silver, oxygen etc. In a most preferred embodiment the photoconductive layer comprises cadmium sulfide doped with copper in an amount up to 80 p.p.m.

Electrically conductive layer (c) may comprise any material forming substantially an electrical contact with photoconductive layer (b) but preferably comprises an aluminium or titanium layer. Conductive layer (c) typically has a thickness of 0.5 μm but may be from 0.1 to 1.0 μm. In a preferred embodiment electrically conductive layer (c) comprises a titanium electrode having a sheet resistivity of approximately 2 ohms/sq. or less.

In situations where the device is used in conjunction with a separate imaging medium, such as a thermally-activated dye donor ribbon, it is highly desirable that an abrasion or wear-resistant layer (d) be formed on the external surface of conductive layer (c) to reduce wear resulting from the contact of thermal imaging media. The wear-resistant layer may also impart friction reducing properties. In situations where a thermally-activated component of an imaging system is coated directly onto the devices, a wear resistant layer may not be necessary. Preferred materials suitable for use in a wear resistant layer comprise alumina, silicon nitride, aluminium nitride, titanium nitride, boron nitride, silicon carbide, silicon oxide, diamond or a diamond-like material or a polymer film which may optionally be crosslinked, e.g., polyimide. In a most preferred embodiment the wear resistant layer comprises titanium nitride and typically has a thickness of 0.5 μm. Generally, the thickness of the wear-resistant layer may be from 0.1 to 10 μm, with a typical value of from 0.1 to 1.0 μm.

The print surface adapted for the provision of localised heating to a thermally-activatable component of an imaging system, such as thermally sensitive paper or a colourant transfer medium, preferably comprises conductive layer (c) or conductive layer (c) in combination with wear resistant layer (d). However, the print surface may comprise any layer of one or more materials having good thermal properties for efficient conductance of heat generated in layer (b) to the selected thermographic medium.

Photoconductive layer (b) is in electrical contact with conductive layer (c) such that free electron flow occurs upon exposure of the thermal imaging device and photoactivation of layer (b). Layers (b) and (c) complete a path of low resistivity unlike the devices of the prior art, for example, Japanese patent No. 61244567 which discloses a thermal imaging device having an additional heat generating layer of high resistivity interposed between a photoconductor and an electrode.

The functional nucleus of the thermal imaging device comprises the trilayer element of (a) to (c) and layer(s) (d) and/or (e), but the nucleus is preferably constructed upon a support substrate for practical purposes. In a preferred embodiment the component layers are sequentially deposited upon a support substrate by r.f. magnetron sputtering under operating conditions known to the art, wherein the substrate may comprise a flexible or non-flexible material but preferably is glass, e.g., borosilicate glass. The parameters for material suitability are (i) high transparency and (ii) a high tolerance to rapid heating and cooling, e.g., the trilayer (a) to (c) may reach temperatures of up to 400° C. The thickness of the substrate is generally greater than 1.0 mm. The trilayer is deposited onto the surface of the substrate in the order: (a), (b), (c) and optional wear resistant layer (d). Following the deposition of layer (a), thermal annealing, e.g., at 300° C., has been found to affect the growth of layer (b) in a manner which may result in a beneficial modification of conductivity to that layer.

In order to prevent heat generated by layer (b) from flowing in the reverse direction and being dissipated too quickly into the support substrate, it may be beneficial to have a thin thermally resistant layer between the substrate and electrically conductive layer (a). The layer must be transparent and should be less thermally conductive than the base but not totally insulating, in order to direct heat into layers (b) and (c). Suitable materials include polyimide, lead oxide and flint glasses containing lead, typically at a thickness of 1.0 μm.

The voltage potential connected across layers (a) and (c) depends on the thickness and make-up of layer (b) and the intensity and dwell time of the exposing source, but is generally from 2 to 40V, more usually 5 to 30V with typical values of about 11 to 17V. By modulating the voltage applied across layers (a) and (c) it is possible to modulate the density of transferred colourant as per continuous tone printing or it is possible to modulate the size of a transferred colourant pixel as per halftone printing.

When the trilayer element (a) to (c) and optional thermal and wear resistant layers are constructed on a transparent substrate, the imaging device in one embodiment may be constructed as a substantially rectangular prism. In a second embodiment the glass substrate may be constructed as a hollow cylinder, wherein layers are deposited on the external surface of the cylinder.

The thermographic image recording medium may comprise any of the thermographic materials known to the art but the format of the thermal imaging device will influence choice. The image recording medium may comprise a thermally sensitive paper held under pressure in intimate contact with the thermal imaging device or a colourant transfer medium such as a ribbon or sheet either impregnated with or having on its surface a thermally transferable colourant, e.g., a wax, ink or dye, or any material capable of modifying a receptor surface, held in intimate association with the thermal imaging device and a colourant receiving substrate.

Alternatively, the colourant transfer medium may constitute an integral component of the thermal imaging device or it may comprise a temporary layer or coating applied to the print surface of the device, for example, in one embodiment a disposable thermal imaging device, which is periodically replaced, may be achieved by coating a colourant transfer layer on electrically conductive layer (c). In a further embodiment the colourant transfer medium may be coated onto the thermal imaging device as an ink, paste or jelly.

Both colourant transfer layer and colourant receiving substrate may be contained in an integral construction comprising a device in which the imagewise exposed thermal imaging device is peeled apart to separate the substrate and desired image from the remainder of the device.

The thermal imaging devices of the prior art utilising thermally transferable colourants are unable to provide very high resolution printing and they are not able to provide a cost effective method of multi-colour printing. One reason for this lies in the construction of the printhead, typically a line of micro-resistors at a density of 125 to 400 d.p.i. (5 to 16 dots per mm) and of length 10 to 30 cm. These miniature heating elements and their interconnects are formed on an alumina substrate by microlithographic techniques. The requirements that all elements must be functional and of uniform resistance at this level of fabrication complexity results in low yield and high device costs. The resolution of these devices is limited to 400 d.p.i. (16 dots per mm). The thermal imaging devices of the present invention having a simplicity of structure and fabrication result in lower production costs and can readily achieve resolutions well in excess of 400 d.p.i. The dimensions of the printheads of the invention are not limited and can readily cover areas of many square centimeters.

Furthermore, the devices of the invention possess additional means of controlling the amount of energy delivered at the print surface compared to devices of prior art. With devices comprising resistive elements, the only variables are the magnitude and duration of the current flow. In the devices of the invention, the variables include the intensity and duration of the light exposure and also the magnitude and duration of the voltage applied across layers (a) and (c), so that the energy delivered to the print surface may be more readily controlled.

The devices of the invention are therefore well suited for continuous tone imaging using the so called dye-diffusion-transfer media. This involves a donor material comprising one or more dyes dispersed molecularly in a suitable binder, such that the dye(s) diffuse to a receptor surface under the action of heat, the amount transferred varying with the thermal energy supplied. The devices of the invention may also be used advantageously with so called mass-transfer media, i.e., imaging media which involves the thermal transfer of dyes or pigments along with a waxy binder. With this type of media, it is impossible to achieve gradations of colour within a transferred pixel; below a given energy threshold no transfer takes place, while at higher energies, complete transfer takes place. However, when these materials are imaged by devices in accordance with the invention, it is unexpectedly found that the size of the transferred pixel may be controlled by varying the voltage applied across layers (a) and (c). By this means, it is possible to simulate grey scales via generation of half-tones, as is commonly practised in conventional (lithographic) printing. This capability represents a significant advantage that is not available using thermal printers of the prior art.

The thermal imaging devices of the present invention have a particular utility in a thermal imaging assembly comprising one or more of the thermal imaging devices and means for the imagewise exposure of said devices. The choice of said imagewise exposure means is selected in response to the function of the thermal imaging assembly, i.e., very high resolution printing or a more cost efficient mono or multi-colour printing process.

For high resolution imaging one or more scanning lasers may provide exposure means. Laser scanners can achieve very high resolutions compared with 300 to 400 d.p.i. thermal printheads of the prior art and so such an imaging assembly can potentially offer very high resolution thermal printing, although limitations may be encountered with the thermal media.

When the thermal imaging device of the invention is addressed by a scanning laser, it is desirable that the dwell-time of the laser per pixel should be as short as possible in order to reduce the total scanning time and increase throughput. Since a fixed amount of energy per pixel is required to develop the imaging media, shorter dwell-times necessitate greater temperature gradients between the heat-generating source (photoconductor layer (b)) and the heat receiving layer (the imaging media). This may necessitate an unreasonably large temperature rise in the photoconductor.

One method of alleviating this situation is to arrange for the device to be heated above ambient temperature independently of exposure by the scanning laser, provided that such heating is insufficient, by itself, to cause thermal development of the imaging media. This may be done by a variety of methods, e.g., external heating of the device, or passing an electric current along either or both of electrodes (a) and (c) so as to produce resistive heating, but the preferred method is to subject the imaging device to uniform, diffuse, low-level illumination. This generates a small photocurrent in layer (b) with concomitant resistive heating, thus raising the temperature by the required amount. This method has an additional advantage in that the response time (the time between onset of laser exposure and attainment of peak photocurrent) is reduced, by virtue of the background photocurrent being present, so that more efficient use is made of each laser pulse. Uniform illumination can be provided by any suitable light source, such as a tungsten filament lamp, preferably comprising means to control illumination intensity, e.g., in response to measurement of the background photocurrent flowing in the imaging device.

An alternative method would be to use one or more laser spots preceding the writing laser spot. Such preceding laser spots cause both carrier generation and pre-warming of the pixel to be written. In order to provide the correct degree of pre-warming etc., the intensity of the laser spot (or spots) on pixels n+1, n+2, would have to be modulated, commensurate with the voltage being written on pixel n. This could be achieved, for example, by modifying the image data by a suitable reference or 'look up' table. The basic effect of this technique is to elongate the exposure time per pixel at faster scanning rates thereby alleviating the temperature rise in the heat generating layer discussed earlier in this section.

The situation that a large temperature rise may be required in the photoconductor at scanning rates of the laser spot, necessary for adequate throughput can also be alleviated by use of the well known behaviour of photoconductors;

$$I \propto P\gamma$$

in which:

I is the photocurrent density, P is the light power per unit volume and $\gamma$ is a number usually in the range $0.5<\gamma<1$.

This relationship implies that if the intensity per pixel were reduced, e.g., by increasing the area of coverage of the illuminating source, the current per pixel would not decrease in direct proportion to the intensity, but less gradually, i.e., current is generated more efficiently over a large area for a given power of illumination.

Therefore, because the total current drawn in the thermal imaging device increases as the illuminated area increases, so too does the total power consumption drawn in the thermal imaging device for a given light source. Hence the time taken to write an image would be reduced compared to that taken to write the same image using a single laser spot. This effect can be utilised, for example, by illuminating the thermal imaging device through a negative of the required image, and using the generated thermal image to transfer the colourants.

For digital imaging purposes, the effect may be used most advantageously with thermal imaging devices of the invention in which at least one of layers (a) and (c) is in the form of a pattern of discrete electrodes, each of which is connected to an independently-modulated voltage supply. For example, one such embodiment could be a device comprising an array of n electrode lines (a) and/or electrode lines (c), addressed by a laser line arranged perpendicular to the array of n electrode lines of the thermal imaging device and which is at least as long as the n-line array is wide. The laser line would then scan in the direction of the electrode lines, each of which is then varied in voltage, or duration of voltage in accordance with electronic image data. In this way n lines of an image are written simultaneously. The spacing of the electrode lines and the width of the laser line will define the resolution of the thermal imaging device.

Different patterns of discrete electrodes are possible for different applications. Thermal imaging devices wherein layer (a) and/or layer (c) is in the form of an array of discrete electrodes may be fabricated by a combination of known techniques of vapour deposition and microlithography. Although this adds to the complexity of the fabrication process, it remains simpler than the fabrication of conventional thermal styli printheads.

Mathematical modelling predicts that, using the above technique it should be possible to write an array of, say, 100 lines of image in approximately 3 to 5 times the time taken to write a single line by single-spot scanning, i.e., a 20 to 30 fold increase in throughput. In practice, it is surprisingly found that the equivalent of over 100 lines can be written in the same time as a single line, giving even greater increases in throughput.

For lower resolution imaging, the thermal imaging device may be exposed by one or more electroluminescent devices such as light emitting diodes or conventional lamps, e.g., filament, halogen, sodium or neon bulbs. For spatial modulation of the exposure means, the imaging assembly may incorporate a liquid crystal shutter (LCS) array.

Liquid crystal shutters currently have line densities similar to thermal printheads at around 300 d.p.i. (12 dots per mm), but are much cheaper to fabricate. For this reason several may be incorporated into a printer without increasing the cost substantially. The resolution of this printhead system is now limited by the LCS. The completed thermal imaging assembly is much less expensive because no microlithographic stages are required for the thermal imaging device and similarly construction of LCS using known techniques is relatively simple and of low expense.

As a result of the increase in cost efficiency a plurality of thermal imaging devices of the present invention, typically 3 or 4 devices corresponding to the colours cyan, yellow, magenta and optionally black may be incorporated into a multi-colour thermal imaging assembly. Each colour is printed by its own thermal imaging device. Each imaging device may be exposed by a single means for exposure or each imaging device may be associated with its own exposure means.

Prior art multi-colour printers, because of their cost, have utilised only a single printhead to transfer the 3 or 4 dye pigments sequentially, i.e., a single colourant donor medium having the 3 or 4 colours printed in series. This is not a desirable format for coated media because of production difficulties and expense in coating such materials. The format is also undesirable when printing an image because the complete 3 or 4 colour section of the ribbon is consumed in printing, no matter how little of each colour is required, resulting in a high cost per copy. Similarly, because each colour is printed in sequence the paper must be re-registered mechanically and the time to print a page becomes lengthy.

In the multi-colour imaging assembly of the present invention, each thermal imaging device may be associated with a donor medium of different uniform colourant. Therefore, the time to produce a print may be reduced, the cost of producing a coloured print is reduced as the colour is only printed when required and the colourant donor medium may be constructed in the simpler format of continuous coloured ribbon leading to more favourable manufacturing costs.

Thermal imaging assemblies incorporating one or more devices of the invention are thus of significant use in forming images via thermally sensitive media where a light image of the original is available. This light image could be a continuous or analogue type of image, but is more commonly a digital image, stored for example on a memory device and to be read out by a computerised system as is the case for many electronic printing machines such as thermal printers, laser printers, ink jet printers etc. The system would control the exposure and address system, i.e., the laser or liquid crystal shutter or the voltage applied across layers (a) and (c) etc., and a thermally printed image obtained by passing the thermally sensitive media over, and in intimate thermal contact with the thermal imaging device(s).

The image recording medium may be exposed in a single dimension or in two dimensions in an image wise fashion. Registration of the image recording medium may be electronic or mechanical.

BRIEF DESCRIPTION OF THE DRAWINGS

The invention will now be described with reference to the accompanying drawings in which:

Referring to FIG. 1, a thermal imaging device comprising a transparent glass substrate (11) supporting; thin thermally resistant layer (2), transparent or semi-transparent electrically conductive layer (3), highly sensitive photoconductive layer (4), electrically conductive layer (5) and abrasion/wear resistant layer (6) forming the print surface. Electrical power supply (11) is connected across electrically conductive layers (3) and (5). During use the device is brought into intimate association with a colourant transfer medium, for example, a ribbon (not shown) coated or impregnated with a colourant, e.g., dye, wax or ink, and a colourant receiving substrate and held under pressure to secure the imaging process. Alternatively the device may be contacted with a thermally sensitive paper.

The 'sandwich' structure of device, colourant medium and substrate (or device and thermally sensitive paper) is then illuminated by either a low power laser or a liquid crystal shutter (LCS) in a thermal imaging assembly. If the illuminated conductance of the photoconductive layer is large enough, then several watts of power may be dissipated in the illuminated region in the form of Joule heating. This "thermal spot" may be used to transfer dyes as in thermal transfer printing. The device is basically an amplifying interface, converting a light source of milliwatts or less into a thermal spot of up to a few watts. The illumination determines when and where to write the spot and can also modulate the transmitted power, but it is the external supply that provides the power.

Figure 1:
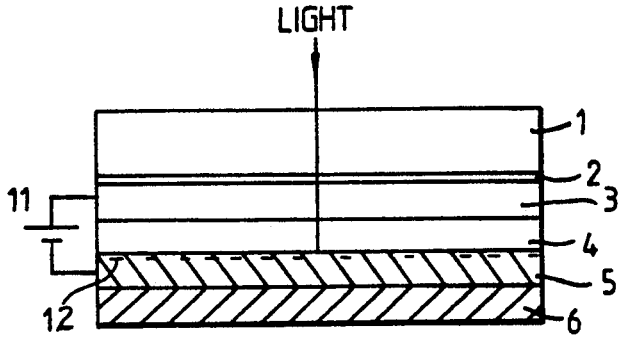
FIG. 1 is a section through a basic embodiment of a thermal imaging device according to the present invention.
Figure 2:
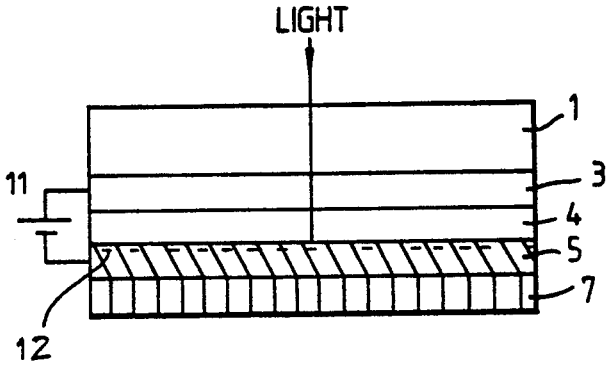
FIG. 2 is a section through a thermal imaging device of the present invention comprising an integral colourant transfer layer.

Referring to FIG. 2, a thermal imaging device is illustrated having a transparent flexible substrate (1) supporting; transparent or semi-transparent electrically conductive layer (3), highly sensitive photoconductive layer (4), electrically conductive layer (5) and colourant containing layer (7). Colourant may comprise an ink, wax or dye which can be transferred to a colourant receiving substrate (not shown) under the action of heating. The embodiment shown effectively provides an integral thermal imaging device and colourant transfer medium and is suitable for use in a thermal imaging assembly having a disposable thermal imaging device. Once colourant layer (7) has been depleted, a new thermal imaging device may be inserted into the imaging apparatus and the old thermal imaging device discarded or returned for recoating. The device has a voltage potential applied across layers (3) and (5) via voltage supply (11) and, in intimate association with a colourant receiving substrate, is exposed to an image forming light source. As per the device of FIG. 1, passage of light through layers (1) to (4) causes thermal transfer of colourant to the colourant receiving substrate.

Figure 3:
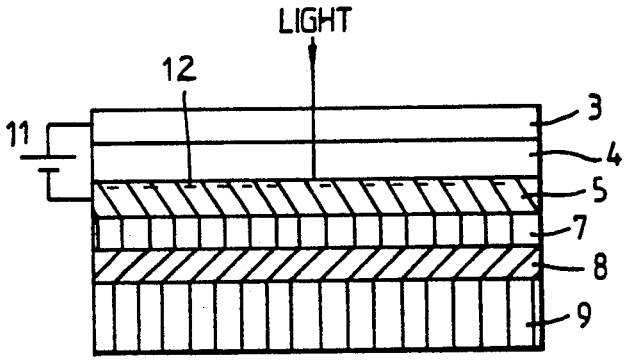
FIG. 3 is a section through a thermal imaging device of the present invention having integral colourant transfer layer and colourant receiving substrate and a peel apart construction.

Referring to FIG. 3, a thermal imaging device is illustrated having a flexible colourant receiving substrate (9) to act as the image receptor and supporting; a receptor/release layer (8) to aid separation during the peel apart of developed substrate, a colourant containing layer (7) which under the action of heating allows transfer of colourant e.g. ink, wax or dye to the receptor/release layer (8), an electrically conductive layer (5) with discrete electrodes (12), a highly sensitive photoconductive layer (4) and a transparent or semi-transparent electrically conductive layer (3).

Electrically conductive layers (3) and (5) are connected to voltage supply (11). Image wise exposure of the device in thermal imaging apparatus causes the transfer of colourants to release/receptor layer (8) by the process described for the device of FIG. 1. The colourant receiving substrate may, subsequent to exposure be peeled apart from the remainder of the printhead aided by release layer (8). The embodiment shown is suitable for a disposable imaging assembly.

Figure 4:
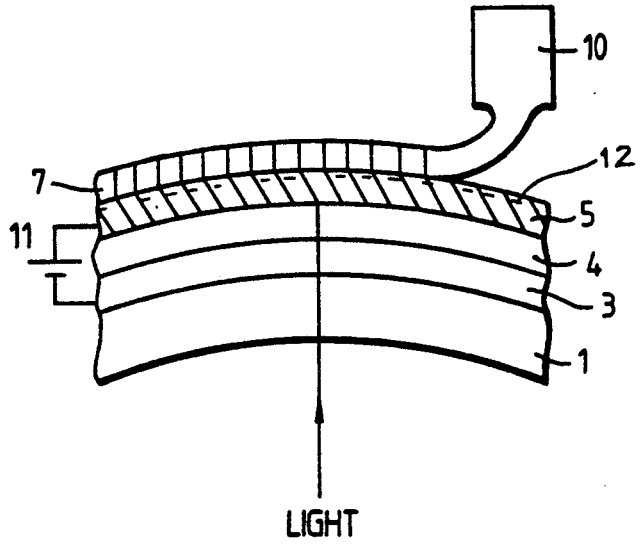
FIG. 4 is a section through a thermal imaging device of the present invention having a drum format and inking station for application of colourant.

Referring to FIG. 4, a thermal imaging device is illustrated having a transparent base substrate (1) comprising a rigid material shaped as a hollow drum, which supports; a transparent or semi-transparent electrically conductive layer (3), a highly sensitive photoconductive layer (4) and electrically conductive layer (5). Electrical power supply (11) is connected across electrically conductive layers (3) and (5). An inking station (10) is provided making contact with the drum, such that electrode layer (5) upon rotation of the drum is coated with a layer of colourant containing medium. In the present embodiment the colourant containing medium is a paste or jelly impregnated with ink. A colourant receiving substrate (not shown) is brought into contact with the inked drum and the photoconductive layer (4) exposed through electrically conductive layer (3) by a light source internal to the drum. Joule Heating as described in the device of FIG. 1 causes colourant to be transferred to the colourant receiving substrate. A further station removes the ink after image transference (not shown).

The invention will now be described with reference to the following non-limiting Examples.

EXAMPLE 1

A thermal imaging device was constructed on a borosilicate glass microscope slide as follows. A 90% indium oxide 10% tin oxide, 8 inch (20 cm) diameter target was r.f. magnetron sputtered at 200W for 30 minutes in an argon atmosphere at 7 microns of mercury pressure, such that an indium tin oxide (I.T.O.) layer was deposited onto the glass microscope slide. During deposition of the I.T.O. layer the glass slide was kept at a temperature of 210°±10° C. The I.T.O. layer was approximately 300 nm thick and exhibited a sheet resistance of approximately 30 ohms/square and greater than 90% light transparency. The temperature of the microscope slide (and I.T.O. layer) was then raised to 230° C. A total of 84 mm of finely divided copper wire of 0.1 mm diameter was then distributed evenly on six circular cadmium sulphide pellets of 1.25 cm diameter and 1 mm thickness, which were symmetrically positioned on an 8 inch (20 cm) diameter cadmium sulphide target. This target was bonded to a copper backing plate and the combined target r.f. magnetron sputtered at 500W for 54 minutes in an argon atmosphere at 7 microns of mercury pressure such that a copper doped CdS (CdS:Cu) layer was formed on the I.T.O. layer on the glass microscope slide. This resulted in an approximately 6 μm thick CdS layer doped with approximately 137 ppm of copper.

The glass slide and I.T.O. and CdS:Cu layers were allowed to cool below 100° C. before an aluminium layer was deposited on the CdS:Cu layer by r.f. magnetron sputtering an 8 inch (20 cm) diameter target at 200W for 20 minutes in an argon atmosphere at 7 microns of mercury pressure. This resulted in an aluminium electrode that exhibited a sheet resistivity of better than 2 ohms/square. Finally an alumina film was deposited onto the aluminium electrode with the substrate temperature still below 100° C., by r.f. magnetron sputtering an 8 inch (20 cm) diameter alumina target at 300 W for 60 minutes in an argon atmosphere at 7 microns of mercury pressure.

When a power supply was connected between the I.T.O. and aluminium electrodes and the thermal imaging device illuminated by a 3mW HeNe laser operating at 633 nm wavelength and focussed to approximately 30 μm spot size, the conductivity of the device was measured to be 0.16 S/cm. The photosensitive ratio of the device, that is the ratio of the illuminated conductivity to the dark conductivity was approximately $10^5$.

A Mitsubishi TLP OHP-11 mass transfer donor sheet and paper with a poly(ethylene-co-acrylic acid) receptor coating were pressed into intimate contact with the imaging device by a silicone rubber roller in order to allow transfer of the donor wax to the receptor coating. In such a mass transfer system the wax is either transferred or not, depending on whether the wax melting point is reached. There is no gradation of colour density within a given dot or pixel. A 820 nm wavelength, 2.5 mW laser diode was focussed to 23 μm at the $1/e^2$ points, then scanned across the thermal imaging device and modulated on and off with a 50% duty cycle. With 11.9V applied between the I.T.O. and aluminium electrodes, several rows of approximately 35 μm to 40 μm diameter dots were written. In a thermal imaging assembly this dot size would correspond to an addressability of approximately 800 d.p.i. (dots per inch) or alternatively as the 5% dot in a 150 line screen halftone printing process. As the best resolution currently available in a conventional thermal printhead is 400 d.p.i. this example demonstrates the higher resolution capability of the thermal imaging devices of the present invention.

EXAMPLE 2

A thermal imaging device was constructed as described in Example 1 except for the copper doped cadmium sulphide layer. This was prepared using a different cadmium sulphide target which was not bonded to a backing plate. 60 mm of finely divided copper wire (0.1 mm diameter) were uniformly distributed on the 8 inch (20 cm) diameter cadmium sulphide target and this target was r.f. magnetron sputtered at 300W for 90 minutes. The glass slide and I.T.O. layer were maintained at a temperature of 170°±10° C. This resulted in a copper doped cadmium sulphide layer of approximately 6 μm thickness and containing approximately 50 ppm of copper. The thermal imaging device exhibited an illuminated conductivity of 1.12 S/cm when addressed by the 3mW HeNe laser operating at 633 nm wavelength, and also exhibited a photosensitive ratio of approximately $1.8\times10^6$.

Using the same laser and scanning system described in Example 1, Hitachi VY-S100 thermal transfer donor sheet and receptor paper system for printing from video was pressed into intimate contact with the thermal imaging device. This particular media utilises a sublimation dye which transfers more readily with increasing temperature. Thus within a given dot or pixel it is possible to have a gradation of colour density depending upon the temperature and hence upon the power transmitted. With 17V applied between the indium tin oxide and aluminium electrodes, several rows of approximately 40 μm dots were written, which exhibited a colour density of 0.90. This density was continuously variable between 0 and 0.9 with the applied voltage. Thus the example demonstrates both the high resolution and the grey scale capability of the thermal imaging device obtained by modulating the voltage.

EXAMPLE 3

A thermal imaging device was constructed as described in Example 2 except that the cadmium sulphide layer was doped with approximately 42 ppm of copper. This thermal imaging device exhibited an illuminated conductivity of 0.2 S/cm and a photosensitive ratio of approximately $3.3\times10^5$, when illuminated by a 3 mW HeNe laser of 633 nm wavelength, and focussed to approximately 30 μm. With 19V applied between the I.T.O. and aluminium electrodes, the 30 μm HeNe laser spot was applied to the thermal imaging device for 2 ms by a shutter. The thermal imaging device was then moved approximately 100 μm horizontally by an x-y manipulator and the exposure repeated. A row of such exposures was made. This caused a row of dots to be transferred from a donor layer containing a sublimable dye to paper having a VYNS resin coating as a receptor. The transferred dots were less than 24 μm in diameter, corresponding to an addressability of over 1000 d.p.i., again demonstrating the high resolution capability of the device.

EXAMPLE 4

A thermal imaging device was constructed as described in Example 2 except that the cadmium sulphide layer was doped with approximately 33 ppm of copper. This thermal imaging device exhibited an illuminated conductance of 0.4 S/cm with a photosensitive ratio of approximately $4\times10^5$, when illuminated by the 3 mW 30 μm spot size, 633 nm wavelength, HeNe laser. Using also the same thermal transfer media described in Example 1, and the exposure system described in Example 3, 12V was applied between the I.T.O. and aluminium electrodes and a row of dots were transferred as described in Example 3 except that the thermal imaging device was moved approximately 250 μm for each exposure. At the end of a row the thermal imaging device was moved approximately 250 μm vertically. The voltage to the electrodes was increased by 1V and a further row of dots transferred. This was continued in IV increments until a row of dots had been written by application of 16V to the electrodes. The result of this experiment was that 5 rows of dots had been transferred that increased in size from approximately 40 μm diameter for the 12V application to approximately 180 μm diameter for the 16V application. Thus the thermal imaging device may modulate dot size by modulation of the applied voltage. Such a variation in dot size would be useful, for example, in a halftone printing system.

EXAMPLE 5

A thermal imaging device was constructed as described in Example 2, but omitting the alumina wear layer. A solution of cyan dye was coated onto the thermal imaging device to a dry thickness of approximately 2 μm. This was accomplished by dissolving 1 g of dye A in 20 g of acetone.

DYE A

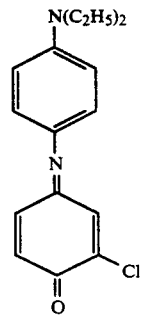

This was added to 30 g of a mixture of; 10 g of ethyl cellulose, 80 g of toluene and 20 g ethanol, and coated at 25 μm wet thickness, thus leaving a dry layer of cyan dye in an ethyl cellulose binder. Paper, coated with poly(vinylidene chloride-vinyl acetate)copolymer (VYNS) resin as the receptor layer, was held in contact with the dye layer under pressure from a neoprene rubber roller. 12.5V was then applied between the I.T.O. and aluminium electrodes, and using the 3 mW, 30 μm spot size, 633 nm wavelength HeNe laser a row of exposures were made as described in Example 3. The thermal imaging device was then raised approximately 100 μm and a further row of exposures were made with the voltage still at 12.5V but with a neutral density filter inserted in the laser beam's path. This process was repeated for several rows of dots and it was found that the optical density of the transferred dots varied in a continuous manner from over 1.0 down to zero as the density of the interposed filter was progressively increased to 1.0. It was also found that the dot diameter varied from 35 μm for the most optically dense dots to under 20 μm for the least dense dots. Thus the density of transferred dye and the dot size may be continuously variable with laser intensity.

EXAMPLE 6

A thermal imaging device was constructed as described in Example I except that the cadmium sulphide layer was deposited by using an 8 inch (20cm) diameter cadmium sulphide target that was doped with 175 ppm of copper and was bonded to a copper backing plate. This target was r.f. magnetron sputtered at 500W for 54 minutes whilst the glass microscope slide and I.T.O. layer were maintained at a temperature of 285°±10° C. The top electrode of aluminium and wear layer of alumina were deposited as described in Example 1. Using the 3 mW, 30 μm spot size, 633 nm HeNe laser, the illuminated conductivity of the thermal imaging device was approximately 0.8 S/cm and the photosensitive ratio was approximately $4.4\times10^6$. This device was illuminated by means of a Casio LCS 300 liquid crystal shutter. The illumination to the shutter was provided by a 150W tungsten halogen lamp source and transmitted by means of Pilkington Glass Co. 60 mm×1 mm linear fibre optic array.

A Mitsubishi TLP OHP-11 cyan donor sheet and transparency receptor were pressed by means of a sprung copper plate to the thermal imaging device and a voltage of 21V was applied between the I.T.O. and aluminium electrodes for 1.15 seconds, while the shutter was transmitting light in the on condition.

It was found that 2 rows of dots had been transferred to the receptor sheet, corresponding to the pixels in the shutter. At a pulse length of 1.2 seconds the rows of dots were better defined, and at 1.25 seconds the rows of dots had started to merge. With the liquid crystal shutter in the off condition and 21V applied to the electrodes, no transfer of material occurred whatsoever at these pulse durations.

Thus the thermal imaging device may be usefully addressed by a liquid crystal shutter, for the purpose of forming a thermally derived image.

EXAMPLE 7

A thermal imaging device was constructed as described in Example 6, except for the top aluminium electrode and alumina wear resistant layer. In this example the top electrode was titanium, deposited by r.f. magnetron sputtering an 8 inch titanium target at 500W for 20 minutes in an argon atmosphere at 10 μm of mercury pressure. The substrate temperature was initially at ambient temperature but was subsequently allowed to increase during deposition. This resulted in the deposition of a titanium layer of approximately 500 nm thickness upon the cadmium sulphide/copper layer. The argon pressure was then reduced to 9 μm of mercury before introduction of nitrogen to the sputtering chamber until a total pressure of 10 μm of mercury was again obtained, i.e., a 10% nitrogen 90% argon atmosphere. The titanium target was r.f. magnetron sputtered in this atmosphere for one hour with 600W applied to the target and 100W to the substrate. This resulted in a titanium nitride layer upon the thermal imaging device which was approximately 150 nm thick.

The abrasion resistance of the titanium nitride wear layer was demonstrated by means of an oscillating arm wear tester. In this test, a 5 mm diameter ceramic ball was placed in contact with the wear resistant (titanium nitride) layer on the thermal imaging device and subjected to a downward force of 60 gm wt. An oscillating mechanical arm then caused the ball to run back and forth across the layer. When a groove had been worn in the imaging device a light detection system caused the arm to stop. The number of passes was recorded on a mechanical counter. It was found that less than 10 passes were required to wear through a thermal imaging device having only an aluminium top electrode and no wear layer. An average of 20 passes were required to wear through an imaging device having only a titanium top electrode and no wear layer. However, it was found that over 1,000 passes were required to wear through the thermal imaging device containing a titanium nitride abrasion resistant layer as described in this Example.

EXAMPLE 8

A thermal imaging device was constructed as described in Example 6. This device was then addressed by a helium-neon laser operating at 633 nm wavelength. The laser exhibited a power of 2 mW at the thermal imaging device, focused to 15 μm at the $1/e^2$ points and scanned by the device at 0.6 m/s in an otherwise dark room.

When Misubishi TLP OHP-11 thermal transfer media was brought into contact with the thermal imaging device, lines of approximately 100 μm width were transferred when 12V was applied between the electrodes of the thermal imaging device.

This same device was then illuminated by a tungsten filament, white light source and the intensity of illumination adjusted to obtain a device conductivity of approximately 5 μS/cm. This corresponded to a background power dissipation of approximately 1W/sq·cm and had the effect of generating carriers in the photoconductor and raising the device temperature somewhat above ambient. When the previously described laser spot was scanned over the thermal imaging device it was found that 100 μm wide lines of the Mitsubishi TLP OHP-11 thermal transfer media were transferred at a faster scanning speed of 6 m/s with the same 12V applied between the electrodes of the thermal imaging device, thus illustrating the advantage of using background illumination to increase the speed of writing of the thermal imaging device.

EXAMPLE 9

A thermal imaging device was constructed on a borosilicate glass microscope slide as follows.

A 90% indium oxixde 10% tin oxide, 8 inch (20 cm) diameter target was r.f. magnetron sputtered at 400W for 30 minutes in $1.5\times10^{-3}$% oxygen/99.9985% argon atmosphere, at a total pressure of 7 microns of mercury, such that an indium tin oxide (I.T.O.) layer was deposited onto the glass microscope slide. During the deposition of the I.T.O. layer the glass slide was maintained at a temperature of 160°±10° C. The I.T.O. layer was approximately 450 nm thick and exhibited a sheet resistivity of approximately 30 ohms/square and greater than 90% light transparency at visible and near infrared wavelengths. The temperature of the microscope slide (and I.T.O. layer) was then raised to 305°±15° C. A cadmium sulphide sputtering target containing 100 p.p.m. copper and measuring 8 inches (20 cm) in diameter was bonded to a copper backing plate and r.f. magnetron sputtered at 300W for 90 minutes in an atmosphere of 99.6% argon 0.4% hydrogen sulphide at a pressure of 7 microns of mercury, such that a copper doped CdS (CdS:Cu) layer was formed on the I.T.O. layer on the glass microscope slide. This resulted in an approximately 6 μm thick CdS:Cu layer.

The glass slide, I.T.O. and CdS:Cu layers were allowed to cool below 150° C. and a portion of the CdS:Cu layer masked before a titanium layer was deposited on the CdS:Cu layer by r.f. magnetron sputtering an 8 inch diameter titanium target at 300W for 60 minutes, resulting in a film that was approximately 0.5 μm thick. The sputtering chamber was then evacuated and 10% nitrogen/90% argon gas introduced into the sputtering chamber at a total pressure of 10 microns of mercury. The titanium target was sputtered at 600W with a bias of 100W on the substrate electrode for 60 minutes. This resulted in a titanium nitride layer which was approximately 0.15 μm thick and exhibited a sheet resistivity of approximately 1 ohm/square. Part of the exposed portion of the cadmium sulphide was etched through to the I.T.O. layer using concentrated nitric acid and two electrical contacts made, one to the titanium nitride and one to the exposed I.T.O. layer. The resulting thermal imaging device exhibited a conductivity of 0.98 S/cm when addressed by a 3 mW He-Ne laser operating at 633nm wavelength and exhibited a photosensitive ratio of approximately $1.5\times10^6$.

Figure 5:
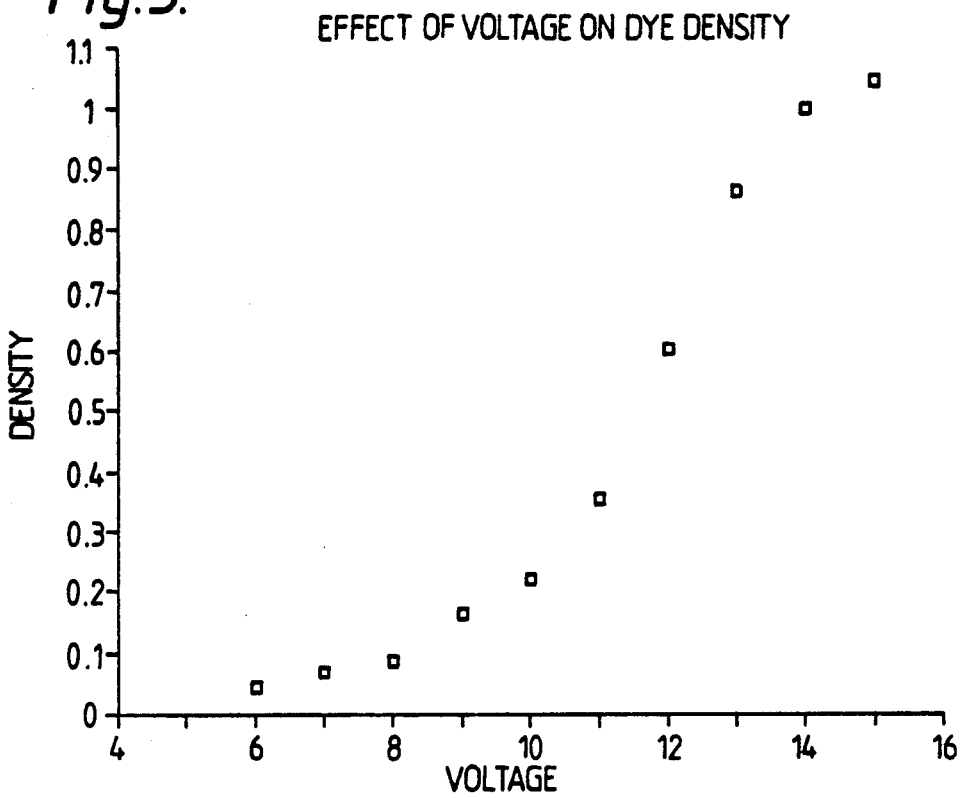
FIG. 5 is a graphical illustration of the effect that modulating the applied voltage has on transferred dye density.

A laser scanning system consisting of a galvanometer driven mirror and a lens provided a focussed 633nm He-Ne laser spot of 25 μm diameter at the $1/e^2$ points which scanned over the thermal imaging device at a speed of 2.5 cm/sec. A suitable voltage was applied to the thermal imaging device which was then exposed to a series of laser scan lines spaced at 42 μm (600 d.p.i.) whilst sublimation dye donor and receptor sheets, commercially available from the Dai Nippon Printing Company, were held in intimate thermal contact with the titanium nitride layer of the thermal imaging device. This resulted in an area of dye transferred to the receptor sheet, the reflected optical density of which was continuously variable with the voltage, see FIG. 5. Thus, it was demonstrated that the transferred dye may exhibit a gradation of colour density dependent upon the voltage applied to the thermal imaging device, i.e., the thermal imaging device can act as a continuous tone type imaging device when addressing such media. A further series of laser scan lines were made at a line separation of 80 μm and the resulting written lines observed to be approximately 40 μm wide indicating that about 600 d.p.i. was the most suitable addressability for the system. When a different lens was inserted in the path of the laser beam to create a 15 μm diameter He-Ne laser spot at the $1/e^2$ points, the lines were approximately 30 μm wide indicating that an addressability of about 800 to 1000 d.p.i. would be suitable, thereby explicitly demonstrating the high resolution capability of the thermal imaging device.

EXAMPLE 10

A thermal imaging device was constructed on a borosilicate glass microscope slide as follows. The glass slide was cleaned and dipped in a solution containing 1 drop of 'Glymo' (Glycidyloxypropyltrimethoxy silane commercially available from Dynamit Nobel (UK) Ltd.) to 75 cl of isopropyl alcohol. A solution of 5% polyimide PIQ13 (commercially available from the Hitachi Chemical Company Ltd.) in N-methyl-2-pyrollidone was spin coated on the glass slide at 3000 r.p.m. The glass slide had been previously masked so that the coating covered only half of the glass slide. The coated slide was then baked at 100° C. for 1 hour, then at 200° C. for 1 hour, and finally at 350° C. for 1 hour and then left to cool.

Figure 6:
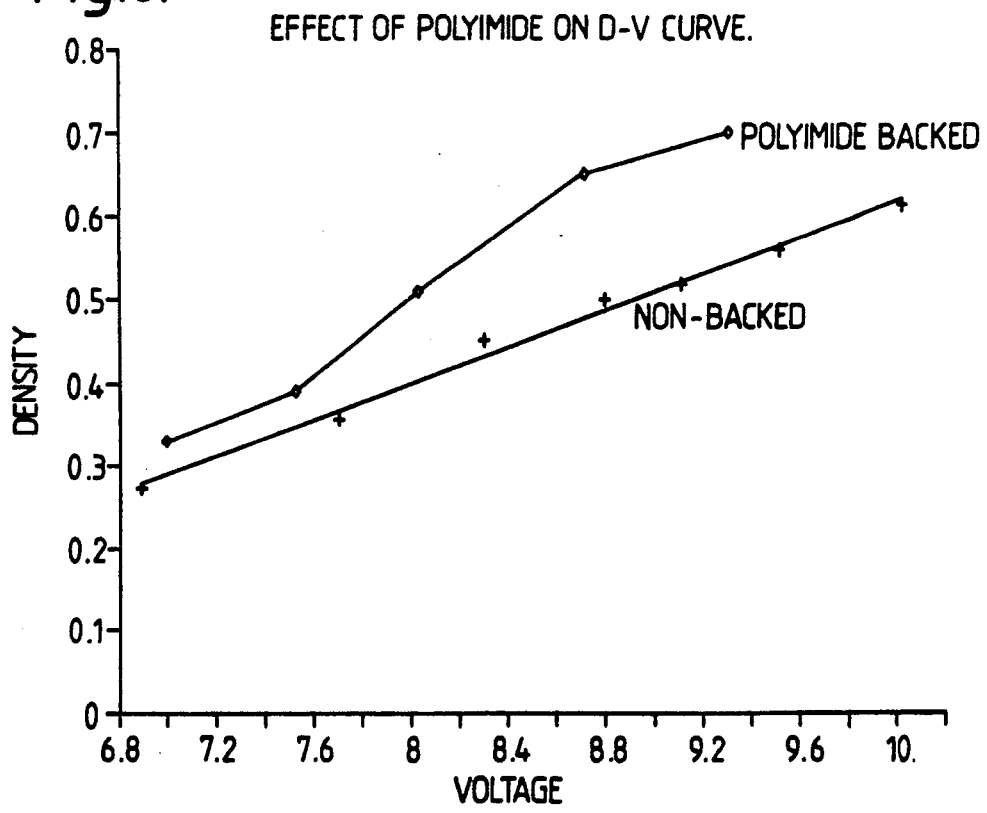
FIG. 6 is a graphical illustration of the effect that a thermally resistive layer has on dye transfer.

Thermal imaging devices were deposited on both the uncoated and polyimide coated portions of the slide in the manner described in Example 9, except that the cadmium sulphide layer was deposited in a sputtering gas atmosphere of 99.5% argon 0.5% hydrogen sulphide, i.e., a slight increase in sulphur content. The thermal imaging devices were addressed by the exposure system described in Example 9 and the transferred dye density measured as a function of the applied voltage, for the device deposited on polyimide and for the device deposited directly upon the glass substrate. The performance comparison is presented graphically in FIG. 6, where it can be seen that the transferred dye was denser at a given voltage for the thermal imaging devices deposited upon the polyimide layer. It was also found that the transferred dye density would decrease at a given printhead voltage with increased scanning speed of the laser spot, because of the reduced energy supplied per pixel. Therefore the density voltage characteristics of a thermal imaging device deposited upon a glass substrate could be achieved at a faster scan rate by a similar device deposited upon a polyimide coated glass substrate.

Hence the use of a polyimide coated substrate reduces the time taken to write an image by a given thermal device.

EXAMPLE 11

A thermal imaging device was constructed on a borosilicate glass substrate measuring 100 mm by 15 mm and 1 mm thick.

The device was fabricated in the same manner as described in Example 9 except that a mask was interposed between the titanium target and the CdS layer in intimate contact with the CdS layer. This mask was designed so that a titanium electrode was deposited on the CdS layer that was 92 mm long and 2 mm wide. Titanium and titanium nitride was then deposited on this area as described in Example 9. Away from this electrode, part of the cadmium sulphide layer was removed along the full length of the substrate by immersing the part to be removed in concentrated nitric acid in order to expose the I.T.O. layer underneath.

A printer was constructed that contained a housing for the above described thermal imaging device and made two electrical contacts to the thermal imaging device; one to the titanium nitride electrode and one to the full length of the indium tin oxide layer. Facility was made to allow sublimation dye donor ribbon and receptor papers, commercially available from the Dai Nippon Printing Company, to be placed in intimate contact with the thermal imaging device. A rubber roller (95 mm in length and 25 mm in diameter) was pressed onto the imaging media to ensure good thermal contact between the imaging media and the thermal imaging device (a pressure of approximately 0.7 kg/cm$^2$). A 3 mW He-Ne laser spot of diameter 25 μm at the $1/e^2$ points was focussed on the CdS layer and caused to scan 86mm along it directly under both the titanium/titanium nitride electrical contact and the area of rubber roller pressure on the imaging media. As the laser beam scanned the imaging device at a rate of 1.3 cm/second, the voltage between the electrodes was varied between 4.25 v and 10 v such that pixels of continuously variable, reflected image density, between 0 and 1.3 were written in accordance with image data supplied from a computer memory. Each pixel was written every 3.2 ms corresponding to a pixel width 42 μm. After this line of 2048 pixels had been written, the rubber roller was rotated by a stepper motor to move the donor and receptor sheets a distance of 42 μm. The laser then rescanned the same portion of the imaging device and a further line of new image data was written. This was repeated 2000 times to produce single colour image separation of $2048\times2000$ pixels (8.6 cm$\times$8.4 cm). The receptor was then rewound, re-registered and the donor sheet replaced by a donor sheet of the next colour separation and written in the same manner as described for the first separation. This was repeated for a third separation to generate a full colour image of 600 d.p.i. resolution in continuous tone.

EXAMPLE 12

A thermal imaging device was constructed on a borosilicate glass microscope slide in the manner described in Example 9 except that the cadmium sulphide layer was deposited in a sputtering gas atmosphere of 99.5% argon 0.5% hydrogen sulphide. This thermal imaging device was then exposed to the laser scanning system described in Example 9 except that a different lens providing a 60 μm diameter spot at the $1/e^2$ points, and was focussed on the cadmium sulphide layer. A potential of 8V was applied to the thermal imaging device which was then exposed to a series of laser scan lines, scanning at 2.7 cm/sec and at a spacing of 42 μm. This caused a transfer of dye, of density 0.34, from sublimation dye donor ribbon to the receptor sheet, both of which are commercially available from Dai Nippon Printing Company, which had again been held in intimate thermal contact with the thermal imaging device.

The experiment was repeated with a cylindrical lens positioned in the laser scanning system to cause the 60 μm diameter laser spot to become a laser line of 5 mm length and approximately 60 μm wide. The cylindrical lens was orientated so that deflection of the mirror caused the laser line to scan in a direction perpendicular to its 5 mm length. This line was scanned at 2.7 $cm^2$/second with only one pass of the line across the thermal imaging device. Holding the sublimation dye transfer media in intimate thermal contact with the thermal imaging device, to which a potential of 35v was applied, a 5 mm wide transfer of dye was effected, of density 0.32.

From this example it is clear that a similar density of dye can be transferred over a much larger area in the same time, by using a laser line instead of a single spot. For example if the titanium/titanium nitride electrode were patterned so that there were 119 electrode lines in a 5 mm wide interval, i.e., a 42 μm spacing between electrode centres, then it would be possible using a 5 mm long laser line, oriented perpendicular to the electrodes, to scan along each electrode simultaneously and to write a given image in a much reduced time compared to the time of writing the same image using a single laser spot. Indeed the speed of writing was far higher than had been anticipated.

"GLYMO" (Dynamit Nobel (UK) Ltd.) is a registered trade name.

We claim:

1. A thermal imaging device having a print surface adapted to provide localized heating to a medium comprising a thermally activatable component of an imaging forming system, the device comprising layers in sequence as follows:

(a) a transparent or semi-transparent electronically conductive layer, (b) a photoconductive layer which when illuminated by radiation of 633 nm wavelength and intensity of $4.0\times10^6$ $W/m^2$ has a conductivity of at least 0.01 S/cm and photosensitive ratio of at least $1\times10^3$, (c) an electrically conductive layer in electrical contact with the photoconductive layer (b) and in contact with (d), a print surface comprising an abrasion-resistant wear layer, wherein the layers are constructed and arranged such that when a voltage potential is applied across layer (a) and layer (c) and the device is exposed through layer (a), areas of layer (b) are exposed, and the exposed areas of layer (b) become conductive, enhancing current flow and generating heat in layer (b) at points corresponding to the exposed areas of layer (b) and causing localized heating at the print surface sufficient to thermally activate said component of an image forming system, the device not containing ferromagnetic garnet materials.

2. A device according to claim 1 wherein:

conductive layer (a) is selected from a group consisting of indium oxide, tin oxide, indium tin oxide, cadmium tin oxide, cadmium indium oxide and mixtures thereof, and metals;

photoconductive layer (b) is selected from a group consisting of cadmium sulfide, cadmium selenide, cadmium telluride, gallium arsenide, lead sulfide, lead selenide, zinc oxide and mixtures thereof, each of which may optionally be doped with one or more compensating acceptors;

conductive layer (c) is selected from a group consisting of aluminum and titanium; and wear layer (d) is selected from a group consisting of alumina, silicon nitride, titanium nitride, aluminum nitride, boron nitride, silicon oxide, silicon carbide, diamond and diamond-like materials and optionally crosslinked polymers.

3. A device according to claim 1 wherein:

conductive layer (a) has a thickness of from 0.1 to 1.0 μm;

photoconductive layer (b) has a thickness of from 1.0 to 20.0 μm;

conductive layer (c) has a thickness of from 0.1 to 1.0 μm; and said wear layer (d) is in contact with layer (c) and said wear layer has a thickness of from 0.1 to 10 μm.

4. A device according to claim 1 wherein successive layers are coated onto a transparent support substrate such that layer (a) is proximal to the substrate and layer (d) is distal to said substrate and wherein the support substrate and coated layers form a substantially rectangular prism or substantially a hollow cylinder or drum.

5. A device according to claim 4 further comprising a transparent, thermally resistive layer interposed between said support substrate and conductive layer (a).

6. A device according to claim 1 wherein either one of conductive layers (a) and (c) is formed as a plurality of discrete electrodes.

7. A device according to claim 6 wherein said print surface has a length and said discrete electrodes are formed as a series of lines extending substantially the length of said print surface.

8. A device according to claim 1 comprising the trilayer (a) to (c) and abrasion-resistant wear layer (d), wherein said print surface comprises conductive layer (c) in combination with abrasion-resistant wear layer (d).

9. A device according to claim 1 in combination with means to apply said medium comprising a thermally activatable component of an image forming system to the print surface.

10. A device according to claim 9 in combination with an image receptor substrate, optionally having a receptor layer, to receive said thermally activatable component.

11. A thermal imaging assembly having at least one thermal imaging device having a print surface adapted to provide localized heating to a medium comprising a thermally activatable component of an imaging forming system, the device comprising layers in sequence as follows:

(a) a transparent or semi-transparent electrically conductive layer, (b) a photoconductive layer which when illuminated by radiation of 633 nm wavelength and intensity of $4.0\times10^6$ W/m$^2$ has a conductivity of at least 0.01 S/cm and a photosensitive ratio of at least $1\times10^3$, (c) an electrically conductive layer in electrical contact with the photoconductive layer (b) and in contact with (d), a print surface comprising an abrasion-resistant wear layer, wherein the layers are constructed and arranged such that when a voltage potential is applied across layer (a) and layer (c) and the device is exposed through layer (a), areas of layer (b) are exposed, and the exposed areas of layer (b) become conductive enhancing current flow and generating heat in layer (b) at points corresponding to the exposed areas of layer (b) and causing localized heating at the print surface sufficient to thermally activate said component of an image forming system, the device not containing ferromagnetic garnet materials, said assembly further comprising means for exposure of said device(s) and means for applying a voltage across layer (a) to layer (c) of each of said devices.

12. A thermal imaging assembly according to claim 11 wherein the means to expose the device(s) is selected from a scanning laser or a light source modulated by a liquid crystal display.

13. A method of recording a visual image which comprises providing a thermal imaging device having a print surface adapted to provide localized heating to a medium comprising a thermally activatable component of an image forming system, the device comprising layers in sequence as follows:

(a) a transparent or semi-transparent electrically conductive layer, (b) a photoconductive layer which when illuminated by radiation of 633 nm wavelength and intensity of 4.0'10$^6$ W/m$^2$ has a conductivity of at least 0.01 S/cm and a photosensitive ratio of at least $1\times10^5$, (c) an electrically conductive layer in electrical contact with the photoconductive layer (b), and (d), a print surface comprising an abrasion-resistant wear layer, and applying an electric potential across layer(a) and layer (c), exposing the device through layer (a) such that the areas of layer (b) are exposed, and the exposed area(s) of layer (b) become conductive thereby enhancing current flow and generating heat in layer (b) at points corresponding to the exposed area(s) of layer (b) and causing localized heating at the surface of the print surface sufficient to generate a visual image from said medium.

14. A method according to claim 13 wherein either one of the conductive layers (a) and (c) of the thermal imaging device is formed as a plurality of discrete electrodes having corresponding electrodes on the other conductive layer and wherein a voltage potential is independently applied across said discrete electrodes and the corresponding electrodes of the other conductive layer during exposure of that region of the device containing said discrete electrodes.

15. A method according to claim 14 wherein said discrete electrodes are formed as a series of lines and wherein said exposing is performed with an exposure means which comprises a linear exposure source arranged perpendicular to a series of lines formed by said discrete electrodes, said source simultaneously exposing said lines and being scanned along said lines whilst independently modulating the voltage potential between each line formed by said discrete electrodes and the corresponding electrodes in the other conductive layer.

16. A thermal imaging device having a print surface adapted to provide localized heating to a medium comprising a thermally activatable component of an imaging forming system, the device consisting essentially of layers in sequence as follows:

(a) a transparent or semitransparent electrically conductive layer, (b) a photoconductive layer having a thickness of 1.0 to 20.0 millimicrons which when illuminated by radiation of 633 nm wavelength and intensity of $4.0\times10^6$ W/m$^2$ has a conductivity of at least 0.01 S/cm and a photosensitive ratio of at least $1\times10^3$, (c) an electrically conductive aluminum or titanium layer in electrical contact with the photoconductive layer (b) and in contact with (d), a print surface comprising an abrasion-resistant wear layer, wherein the layers are constructed and arranged such that when a voltage potential is applied across layer (a) and layer (c) and the device is exposed through layer (a), areas of layer (b) are exposed, and the exposed areas of layer (b) become conductive, enhancing current flow and generating heat in layer (b) at points corresponding to the exposed areas of layer (b) and causing localized heating at the print surface sufficient to thermally activate said component of an image forming system, the device being free of ferromagnetic garnet materials.

17. A thermal imaging device having a print surface adapted to provide localized heating to a medium comprising a thermally activatable component of an imaging forming system, the device comprising layers in sequence as follows:

(a) a transparent or semi-transparent electrically conductive layer, (b) a photoconductive layer which when illuminated by radiation of 633 nm wavelength and intensity of $4.0\times10^6$ W/m$^2$ has a conductivity of at least 0.01 S/cm and a photosensitive ratio of at least $1\times10^3$, (c) an electrically conductive layer in electrical contact with the photoconductive layer (b) and in contact with (d) a print surface comprising an abrasion-resistant wear layer, wherein the layers are constructed and arranged such that when a voltage potential is applied across layer (a) and layer (c) and the device is exposed through layer (a), areas of layer (b) are exposed, and the exposed areas of layer (b) become conductive, enhancing current flow and generating heat in layer (b) at points corresponding to the exposed areas of layer (b) and causing localized heating at the print surface sufficient to thermally activate said component of an image forming system, the device not containing ferrimagnetic garnet materials.

* * * * *

UNITED STATES PATENT AND TRADEMARK OFFICE

CERTIFICATE OF CORRECTION

PATENT NO. : 5,262,800

DATED : November 16, 1993

INVENTOR(S) : Smith et al.

It is certified that error appears in the above-indentified patent and that said Letters Patent is hereby corrected as shown below:

Column 1, line 55, delete "physics"
and insert --Physics--.

Column 2, line 46, after the word "comprising"
and before the word "non-", insert --a--.

Column 10, line 30, delete "(11)"
and insert --(1)--.

Column 12, lines 63, 64, and 67 delete "sulphide"
and insert --sulfide--.

UNITED STATES PATENT AND TRADEMARK OFFICE

CERTIFICATE OF CORRECTION

PATENT NO. : 5,262,800

DATED : November 16, 1993

INVENTOR(S) : Smith et al.

It is certified that error appears in the above-indentified patent and that said Letters Patent is hereby corrected as shown below:

Column 13, lines 3, 30 and 52, delete "sulphide" and insert --sulfide--.

Column 14, lines 59 and 61, delete "sulphide" and insert --sulfide--.

Column 15, line 39, delete "sulphide/copper" and insert --sulfide/copper--.

Column 16, lines 48 and 52, delete "sulphide" and insert --sulfide--.

UNITED STATES PATENT AND TRADEMARK OFFICE

CERTIFICATE OF CORRECTION

PATENT NO. : 5,262,800

DATED : November 16, 1993

INVENTOR(S) : Smith et al.

It is certified that error appears in the above-indentified patent and that said Letters Patent is hereby corrected as shown below:

Column 17, lines 3 and 59, delete "sulphide" and insert --sulfide--.

Column 17, lines 60-61, delete "sulphide," and insert --sulfide,--.

Column 18, line 27, delete "sulphide" and insert --sulfide--.

Column 19, lines 5, 7 and 11 delete "sulphide" and insert --sulfide--.

UNITED STATES PATENT AND TRADEMARK OFFICE

CERTIFICATE OF CORRECTION

PATENT NO. : 5,262,800

DATED : November 16, 1993

INVENTOR(S) : Smith et al.

It is certified that error appears in the above-indentified patent and that said Letters Patent is hereby corrected as shown below:

Column 16, line 10, delete "Misubishi" and insert --Mitsubishi--.

Column 17, line 48, delete "5%" and insert --50%--.

Column 19, line 59, after the word "and" and before the word "photosensitive", insert --a--.

Column 21, line 43, delete "$4.0'10^6$ and insert --$4.0 \times 10^6$--.

Signed and Sealed this

Eighth Day of November, 1994

Bruce Lehman

*Attest:*

BRUCE LEHMAN

*Attesting Officer*

*Commissioner of Patents and Trademarks*